US007367430B2

(12) United States Patent
Ach et al.

(10) Patent No.: US 7,367,430 B2
(45) Date of Patent: May 6, 2008

(54) ELEVATOR SYSTEM

(75) Inventors: Ernst Friedrich Ach, Ebikon (CH); Pablo Cruz Bello, Zaragoza (ES)

(73) Assignee: Inventio AG, Hergiswil NW (CH)

( * ) Notice: Subject to any disclaimer, the term of this patent is extended or adjusted under 35 U.S.C. 154(b) by 127 days.

(21) Appl. No.: 10/849,981

(22) Filed: May 20, 2004

(65) Prior Publication Data

US 2005/0006179 A1 Jan. 13, 2005

(51) Int. Cl.
*B66B 11/00* (2006.01)

(52) U.S. Cl. ..... 187/254; 187/255; 187/266; 187/268

(58) Field of Classification Search ..... 187/254, 187/255, 266, 268
See application file for complete search history.

(56) References Cited

U.S. PATENT DOCUMENTS

| | | | | |
|---|---|---|---|---|
| 5,891,561 | A * | 4/1999 | Kinoshita et al. | 428/295.1 |
| 6,056,656 | A | 5/2000 | Kitano et al. | |
| 2002/0098935 | A1* | 7/2002 | Danhauer et al. | 474/261 |
| 2002/0112924 | A1* | 8/2002 | Mori et al. | 187/290 |
| 2002/0185338 | A1* | 12/2002 | Bauer | 187/254 |
| 2003/0121729 | A1* | 7/2003 | Heinz et al. | 187/254 |

FOREIGN PATENT DOCUMENTS

| | | | |
|---|---|---|---|
| CN | 1298367 A | | 6/2001 |
| WO | WO99/43599 | | 9/1999 |
| WO | WO9943589 | * | 9/1999 |

* cited by examiner

*Primary Examiner*—Patrick Mackey
*Assistant Examiner*—Terrell Matthews
(74) *Attorney, Agent, or Firm*—Fraser Clemens Martin & Miller LLC; William J. Clemens

(57) ABSTRACT

A wedge-ribbed belt supports an elevator car in a cantilevered mode and engages a drive pulley of a drive mounted at the head of an elevator shaft. The belt has a running surface facing the drive pulley with a plurality of ribs and grooves extending in parallel in a longitudinal direction of the belt. The ribs and grooves can be triangular-shaped or trapezium-shaped in cross section. A plane of the drive pulley is arranged vertically and at right angles to a car wall at a counterweight side of the elevator car.

11 Claims, 3 Drawing Sheets

ELEVATOR SYSTEM

BACKGROUND OF THE INVENTION

The present invention relates to elevator systems having flat belts supporting the elevator car.

Elevator systems of the kind according to the present invention usually include an elevator car and a counterweight which are movable in an elevator shaft or along free-standing guide devices. The guide device for the elevator car in that case consists on the one hand of guide rails which are arranged in a fixed position in the elevator shaft at one side of the elevator car and on the other hand of car guide rails fastened to a side of the elevator car. For producing the movement, the elevator system includes at least one drive with at least one respective drive pulley which by way of support and drive means supports the elevator car and the counterweight and transmits the necessary drive forces to these.

The support means or drive means are termed support means in the following description.

In the case of conventional elevator systems, steel cables with a round cross-section are usually used as support means. However, flat, belt-like support means are increasingly used for more modem systems.

An elevator system according to the cantilever principle with flat-belt-like support means is described in the technical article "Hannover Messe: Neue Idee von ContiTech-Hubgurte für Aufzüge" (ContiTech initiativ, January 1998).

The article discloses an elevator for automobile body works in which a guide device, which comprises two guide columns, with integrated counterweight is present on one side of an elevating platform. At the upper end the two guide columns are connected together by a platform on which a drive motor is arranged, which acts by way of two drive pulleys on two flat support means strands by which the elevating platform and the counterweight can be moved upwardly and downwardly along the guide columns. In each instance one of the flat-belt-like support means is connected, on the side of the elevating platform facing the guide device, with the platform and extends from this support means fixing point vertically upwards to the side, which faces the elevating platform, of the periphery of the associated drive pulley, loops around this through 180° and then runs vertically downwards to a second support means fixing point present at the counterweight.

A drawing in the mentioned technical article indicates that with use of the same technique a passenger elevator car can also be moved instead of the elevating platform.

For simplification, in the following there is used, instead of different expressions for the form of elevator receiving means, only the term "elevator car" which refers exclusively to load receiving means in a "cantilever arrangement".

An elevator system as described in the foregoing has, thanks to the use of flat-belt-like support means, the advantage that drive pulleys as well as deflecting rollers and support rollers can be used with a substantially smaller diameter than would be allowed in the case of use of a conventional wire cable. As a consequence of the smaller drive pulley diameter the drive torque required at the drive pulley is reduced, whereby a drive motor with smaller dimensions can be used. Due to this and thanks to the generally smaller support means pulley diameter, particularly space-saving elevator systems can be realized.

However, such elevator systems have certain disadvantages.

As a consequence of the small drive pulley diameter and because, in the case of the use of flat belts as support means known measures for improving traction capability, for example undercutting of the cable grooves at the drive pulleys for round support means, are not usable, the problem can arise in the case of a relatively large weight ratio between fully laden and empty elevating platform or elevator car that the traction forces transmissible between drive pulley and flat-belt-like traction means are not sufficient.

In addition, it is known that in the case of use of flat-belt-like support means without profiling the running surface, significant problems arise with lateral guidance of the support means on the drive pulley and, if they should be present, deflecting rollers and support rollers. Experience has shown that there is the risk that the support means rubs so strongly against the lateral boundary discs, which are usually present at the drive pulleys, deflecting rollers and support rollers, that the support means are damaged.

SUMMARY OF THE INVENTION

The present invention has an object of creating an elevator system in a cantilever mode of construction with flat-belt-like support means which does not have the above-stated disadvantages.

The proposed solution according to the present invention substantially consists in replacing the flat-belt-like support means with flat running surfaces by a wedge-ribbed belt. A wedge-ribbed belt has in the region of its running surface several ribs and grooves which extend parallel in a belt longitudinal direction and the cross-sections of which exhibit flanks extending in a wedge shape. When running around the drive pulley, at the periphery of which ribs and grooves are similarly present and are complementary to those of the wedge-ribbed belt, the wedge-shaped ribs of the wedge-ribbed belt are pressed into the wedge-shaped grooves of the drive pulley. In that case, as a consequence of the wedge shape the perpendicular forces arising between drive pulley and wedge-ribbed belt increase so that an improvement in the traction capability between drive pulley and belt results.

Moreover, the interengagement of the ribs and grooves of the wedge-ribbed belt in those of the pulley and rollers ensures an excellent lateral guidance of the support means distributed over several rib and groove flanks.

The elevator system according to the present invention obviously also embraces embodiments with at least two support means strands (wedge-ribbed belts) arranged parallel to one another.

According to a preferred refinement of the present invention the cross-sections of the ribs and grooves of the wedge-ribbed belt are substantially triangular or trapezium-shaped. Wedge-ribbed belts with triangular or trapezium-shaped ribs and grooves can be manufactured particularly simply and economically.

An advantageous compromise between the demands on running quietness and on traction capability is achieved if the triangular or wedge-shaped ribs and grooves have between the lateral flanks thereof an angle which lies between 80° and 100°.

In a particularly suitable form of embodiment of the elevator system according to the present invention wedge-ribbed belts are present in which the angle between the lateral flanks of the ribs and grooves amounts to 90°.

Wedge-ribbed belts which allow particularly small bending radii, i.e. are suitable for use in combination with drive pulleys, deflecting rollers and support rollers with particularly small diameters, have transverse grooves on a side provided with ribs and grooves. The bending stresses, which arise when running around pulleys and rollers, in the wedge-ribbed belt are thus substantially reduced.

To ensure sufficient operational safety of the elevator system several separate wedge-ribbed belts arranged parallel to one another are provided as support means.

Particularly significant advantages with respect to the torque required at the drive pulley and thus the dimensions of the drive motor as well as with respect to the overall dimensions of the elevator installation are achieved by an elevator system according to the present invention of at least the drive pulley, but also all deflecting or support rollers which may happen to be present have an outer diameter of 70 millimeters to 100 millimeters. Previous tests have led to recognition that the diverse requirements and load limits can be fulfilled in optimum manner by pulley and outer diameters of 85 millimeters.

According to a preferred embodiment of the present invention two vertical guide columns are installed in stationary positions on one side of the elevator car and have guide rails for the counterweight and elevator car arranged between the guide columns. The drive motor, drive pulley shaft and drive pulley are in that case mounted on a drive bracket which is carried by at least one of the guide columns. It is thus achieved that the vertical loads, which act on the drive pulley, and the weight of the drive motor are for the greatest part conducted by way of the guide columns into the foundation of the elevator shaft and do not load the walls of the elevator shaft.

The drive motor, which is equipped with an integrated brake, the drive pulley shaft and the drive pulley are placed in a space which lies between the wall, which is at the guide side, of the elevator car disposed in its uppermost position and the wall, which is at the guide side, of the elevator shaft, wherein the axis of the drive pulley is arranged horizontally and parallel to the wall of the elevator car at the guide side. With this elevator arrangement the dimensions, which turn out to be small thanks to the use of wedge-ribbed belts as support means, of the drive pulleys and the drive motor are used for the purpose of so arranging the entire drive that only a minimum shaft head height is required above the elevator car standing in its uppermost position.

The wedge-ribbed belt serving as support means is connected on the side, which faces the guide device of the elevator car at a first support means fixing point with this, extends from this first support means fixing point vertically upwards to the side, which faces the elevator car, of the periphery of the associated drive pulley, loops around the drive pulley by 180° and then runs vertically downwards to a second support means fixing point present at the counterweight. This particularly simple and economic support means arrangement can be realized, in the case of a large ratio between the weights of the full and the empty elevator car, virtually only thanks to the increased traction capability of the wedge-ribbed belt.

An additional reduction in the dimensions of the drive motor and thus a minimization of the installation space, which is required between the wall of the elevator car at the guide side and the wall of the elevator shaft at the guide side, for the drive can be achieved in that there is installed between the drive output shaft of the drive motor and the drive pulley shaft a belt transmission by which the drive output torque of the drive motor required at the drive output shaft of the drive motor is reduced.

A high degree of operational safety of the belt transmission with virtually slip-free torque transmission can be achieved if the transmission is realized with a cogged belt or with a wedge-ribbed belt.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
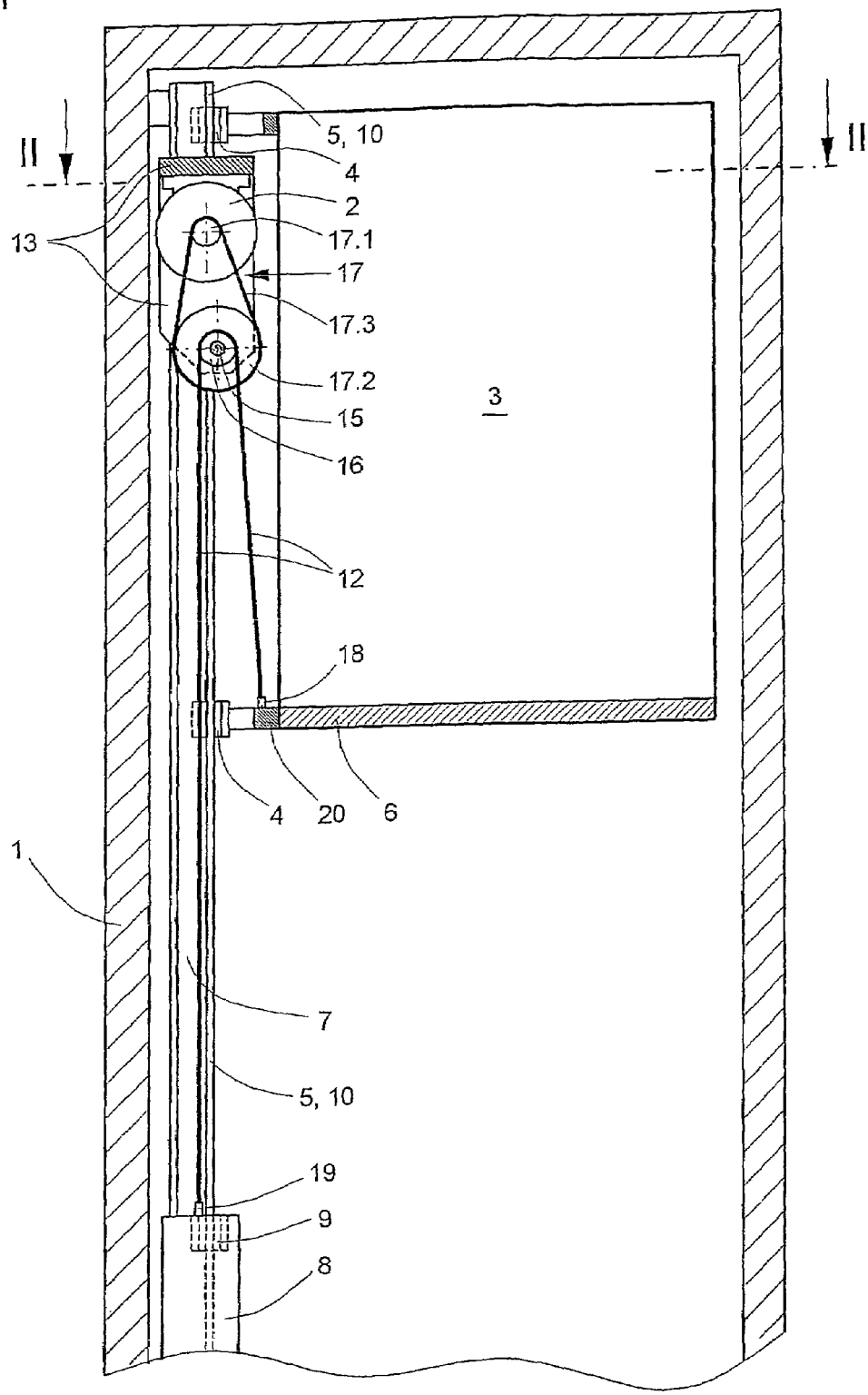
FIG. 1 is a fragmentary front elevation cross-sectional view through an elevator system according to the present invention.
Figure 2:
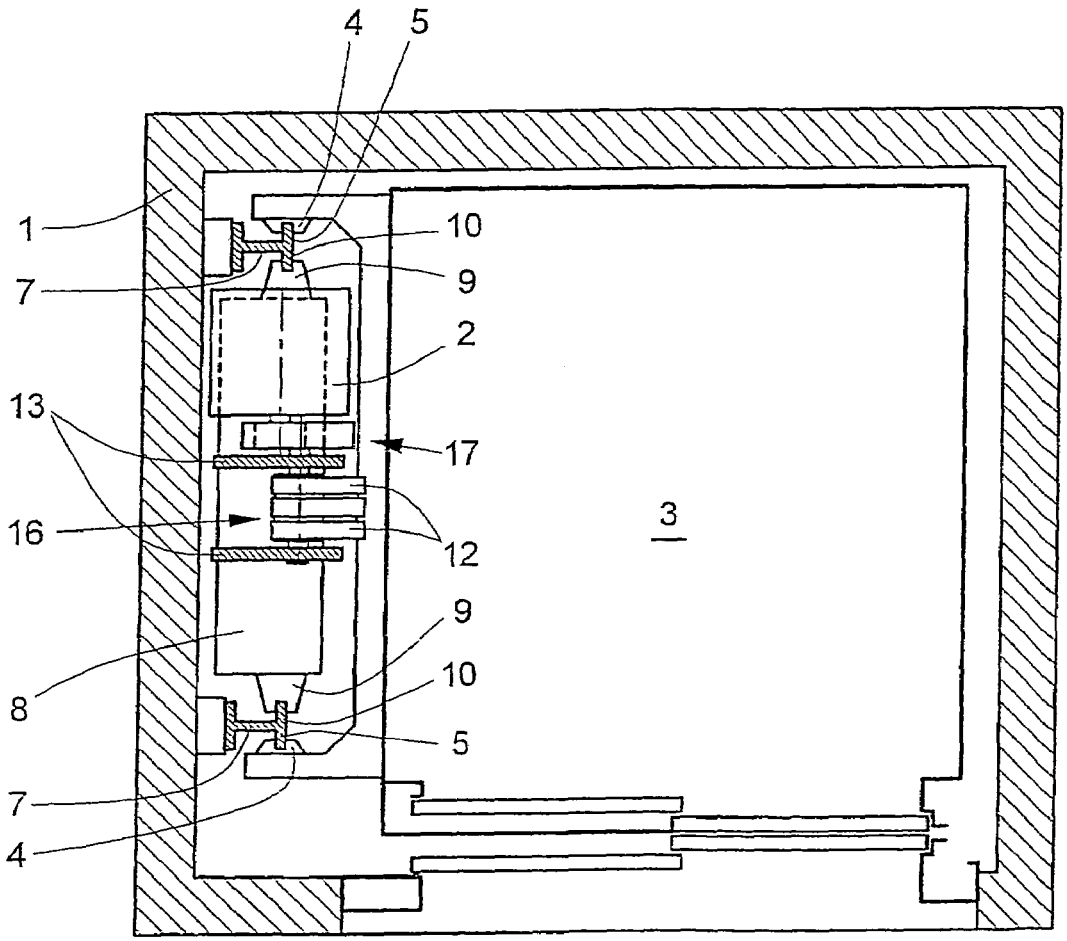
FIG. 2 is a cross-sectional plan view of the elevator system according to the present invention taken along the line II-II in FIG. 1.

FIGS. 1 and 2 show an elevator system according to the present invention. FIG. 1 corresponds with a section through the elevator car parallel to its front side. FIG. 2 illustrates a horizontal section, which is taken through the shaft head region, through the elevator system, the position of which is marked in FIG. 1 by the line II-II. An elevator shaft is characterized by reference numeral 1, in which a drive motor 2 moves, by way of a drive pulley 16 and flat-belt-like support means 12, an elevator car 3 of a cantilever mode of construction and a counterweight 8 upwardly and downwardly. The elevator car 3 is guided by means of car guide shoes 4 at two car guide rails 5 and the counterweight 8 is guided by means of counterweight guide shoes 9 at two counterweight guide rails 10. The mentioned guide rails are each part of two vertical guide columns 7, which are fixed laterally of the elevator car 3 in stationary positions in the elevator shaft 1.

The drive motor 2, preferably an asynchronous motor with integrated brake unit, is arranged in the shaft head region between the wall, which is at the guide side, of the elevator car 3 standing in its uppermost position and the wall, which is at the guide side, of the elevator shaft 1 and drives the drive pulley 16 which acts on several wedge-ribbed belts 12 by way of a belt transmission 17. The axis of the drive pulley 16 is arranged horizontally and parallel to the wall of the elevator car at the guide side. In order to be able to design the mentioned installation space for the drive to be as narrow as possible the support means 12 are constructed as wedge-ribbed belts. It is thereby achieved that the drive pulley 16 with a diameter of 70 millimeters to 100 millimeters—preferably 85 millimeters—is sufficient in order to transmit the necessary traction force to the support means and in that case to avoid an impermissibly high loading of the support means in bending. Thanks to the small drive pulley diameter the torque to be applied to the drive pulley shaft is, for a given traction force, correspondingly small. The drive torque demanded of the drive motor 2 is additionally reduced with the help of the belt transmission 17. Since the diameter of electric motors is approximately proportional to the torque which can be generated, the dimensions of the drive motor 2 and thus of the entire installation space for the described drive arrangement are kept to a minimum.

The drive motor 2, a motor belt pulley 17.1, a belt pulley 17.2 acting on a drive pulley shaft 15 as well as the belt transmission 17, which comprises cogged belts or wedge-ribbed belts 17.3, and the drive pulley shaft 15 with the drive pulley 16 are fastened to or mounted on a drive bracket 13 which is fastened to the two guide columns 7. The weight forces and acceleration forces from the elevator car 3 and the counterweight 8 and acting by way of the support means on the drive pulley are for the greatest part conducted by way of the guide columns 7 into the foundation of the elevator shaft 1 so that the walls of the elevator shaft 1 are not loaded.

The wedge-ribbed belts 12 serving as support means are fastened by one end thereof to a beam 20 projecting at the guide side from a car floor 6 of the elevator car 3. From this first support means fixing point 18 the wedge-ribbed belt 12 extends upwards to the side, which faces the elevator car 3, of the periphery of the drive pulley 16, loops around this by approximately 180°, and extends from the side, which is remote from the elevator car, of the periphery of the drive pulley downwardly to a second support means fixing point 19 present at the upper side of the counterweight 8.

The present description always refers, for the sake of simplicity, to an elevator system with several support means strands arranged parallel to one another. The drive pulley can in that case be integral or assembled from several wedge-ribbed discs. Obviously, the elevator system according to the present invention can also be constructed with only one support means strand (wedge-ribbed belt) insofar as this guarantees the actually required operating safety.

Figure 3:
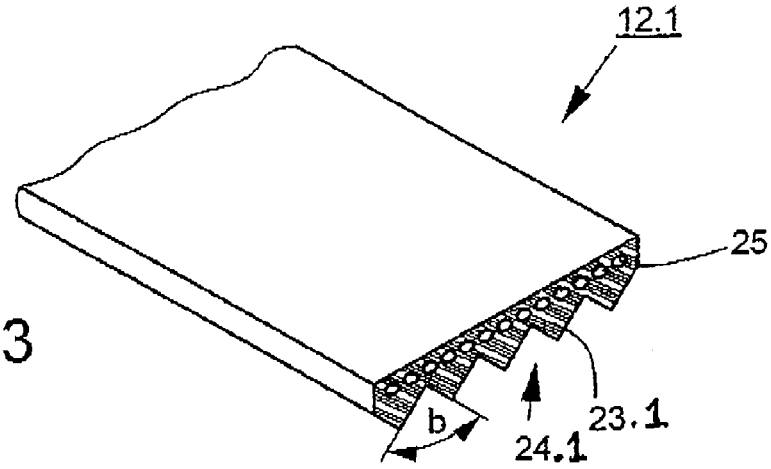
FIG. 3 is a perspective cross-sectional view of a wedge-ribbed belt according to the present invention with triangular ribs and grooves.
Figure 4:
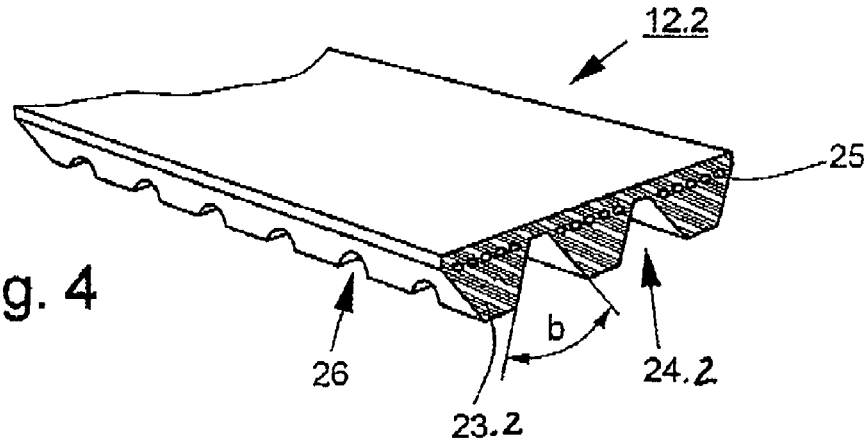
FIG. 4 is a perspective cross-sectional view of a wedge-ribbed belt according to the present invention with trapezium-shaped ribs and grooves.

FIGS. 3 and 4 show possible embodiments 12.1 and 12.2 of the wedge-ribbed belt 12, which is usable for the elevator system according to the present invention, with ribs and grooves oriented in a longitudinal direction of the belt. Preferably at least that layer of the wedge-ribbed belt 12 containing the ribs and grooves is made of polyurethane.

In FIGS. 3 and 4 it can also be recognized that the wedge-ribbed belt 12 contains tensile carriers 25 which are oriented in the longitudinal direction thereof and which consist of metallic strands (for example, steel strands) or non-metallic strands (for example: of synthetic fibers or chemical fibers). Tensile carriers can also be present in the form of metallic flat pieces of fabric or flat pieces of fabric made from synthetic fibers. Tensile carriers impart to the wedge-ribbed belt 12 the requisite tensile strength and/or longitudinal stiffness. In the case of the embodiment 12.1 according to FIG. 3, a plurality of ribs 23.1 and grooves 24.1 formed in a running surface have a triangular cross-section. In the case of the embodiment 12.2 according to FIG. 4, a plurality of ribs 23.2 and grooves 24.2 formed in the running surface have a trapezium-shaped cross-section. An angle "b" present between the flanks of a rib or a groove influences the operating characteristics of a wedge-ribbed belt, particularly the running quietness thereof and the traction capability thereof. Tests have shown that it is applicable within certain limits that the larger the angle "b" the better the running quietness and the worse the traction capability. With consideration of the demands on running quietness as well as traction capability the angle "b" should lie between 80° and 100°. An optimum compromise between the opposing requirements is achieved by wedge-ribbed belts in which the angle "b" lies at approximately 900.

A further embodiment of the wedge-ribbed belt 12 is recognizable from FIG. 4. The wedge-ribbed belt 12.2 has, apart from the wedge-shaped ribs 23.2 and grooves 24.2, also transverse grooves 26. These transverse grooves 26 improve the flexibility of the wedge-ribbed belt 12.1 in bending so that this can co-operate with belt pulleys with extremely small diameters.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system comprising:

a drive motor mounted at a head of an elevator shaft and having a drive pulley;

an elevator car movable in the elevator shaft in a cantilever mode along guide rails positioned at one side of said elevator car;

a counterweight movable in the elevator shaft and arranged laterally of said elevator car; and a flat-belt-like support means supporting said elevator car and engaging said drive pulley, said support means being a wedge-ribbed belt having a running surface facing said drive pulley and a plurality of ribs and grooves formed in said running surface and extending in parallel in a longitudinal direction of said support means, said ribs and grooves being one of triangular-shaped and trapezium-shaped in cross section and formed with lateral flanks at an angle in a range of 80° to 100°.

2. The elevator system according to claim 1 wherein said angle is 90°.

3. The elevator system according to claim 1 wherein said wedge-ribbed belt has a plurality of transverse grooves formed in said running surface.

4. The elevator system according to claim 1 wherein said support means includes at least two wedge-ribbed belt strands arranged in parallel.

5. The elevator system according to claim 1 wherein said drive pulley has an external diameter in a range of 70 millimeters to 100 millimeters.

6. The elevator system according to claim 1 including a pair of vertical guide columns mounted in the elevator shaft at said one side of said elevator car, each said guide column having one of said car guide rails and a counterweight guide rail formed thereon, and wherein said drive motor together with said drive pulley are mounted on a drive bracket attached to at least one of said guide columns.

7. The elevator system according to claim 1 wherein said drive motor and said drive pulley are mourned in a space which lies between said one side of said elevator car, when said elevator car is standing in an uppermost position in the elevator shaft, and an adjacent wall of the elevator shalt and an axis of said drive pulley is arranged horizontally and parallel to said one side of said elevator car.

8. The elevator system according to claim 1 wherein said wedge-ribbed belt is connected at one end at said one side of said elevator car at a first support means fixing point extends from said first support means fixing point vertically upwards to a side, which faces said elevator car, of a periphery of said drive pulley, loops around said drive pulley by 180° and then runs vertically downwards to a second support means fixing point at said counterweight.

9. The elevator system according to claim 1 including a belt transmission means coupling said drive motor to said drive pulley.

10. The elevator system according to claim 9 wherein said belt transmission means includes at least one of a cogged belt and a wedge-ribbed belt coupling said drive motor to said drive pulley.

11. An elevator car support for use in an elevator system having a chive motor mounted at a head of an elevator shaft and having a drive pulley for engaging the support, the support comprising: a wedge-ribbed belt adapted to support the elevator car in a cantilever mode and engaging the drive pulley, said belt having a running surface adapted to face the drive pulley and a plurality of ribs and grooves formed in said running surface and extending in parallel in a longitudinal direction of said belt, said ribs and grooves being one of triangular-shaped and trapezium-shaped in cross section and being formed with lateral flanks at an angle in a range of 80° to 100°.

* * * * *

UNITED STATES PATENT AND TRADEMARK OFFICE

CERTIFICATE OF CORRECTION

PATENT NO. : 7,367,430 B2
APPLICATION NO. : 10/849981
DATED : May 6, 2008
INVENTOR(S) : Ernst Friedrich Ach et al.

It is certified that error appears in the above-identified patent and that said Letters Patent is hereby corrected as shown below:

Title Page, item 62 Insert This application is a CON of PCT/CH02/00634 11/22/2002

Title Page, item 30 Priority Document: Insert
EUROPEAN PATENT OFFICE (EPO) 01811132.8 11/23/2001

Signed and Sealed this

Sixteenth Day of September, 2008

JON W. DUDAS
*Director of the United States Patent and Trademark Office*